US006224440B1

(12) United States Patent
Shimizu

(10) Patent No.: US 6,224,440 B1
(45) Date of Patent: May 1, 2001

(54) WATERCRAFT EXHAUST SYSTEM

(75) Inventor: Takayuki Shimizu, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/199,844

(22) Filed: Nov. 25, 1998

(30) Foreign Application Priority Data

Nov. 27, 1997 (JP) ..... 9-326084

(51) Int. Cl.[7] ..... B63H 21/32
(52) U.S. Cl. ..... 440/89; 60/310; 181/260
(58) Field of Search ..... 440/89; 60/309, 60/310; 181/260, 261

(56) References Cited

U.S. PATENT DOCUMENTS 4,781,021 * 11/1988 Winberg ..... 440/89
5,572,943 * 11/1996 Kobayashi et al. ..... 440/89
5,746,630 * 5/1998 Ford et al. ..... 440/89
6,030,263 2/2000 Uchino et al. ..... 440/89

* cited by examiner

*Primary Examiner*—Jesus D. Sotelo
(74) *Attorney, Agent, or Firm*—Knobbe, Martens, Olson & Bear LLP

(57) ABSTRACT

Embodiments of personal watercraft that incorporate improved exhaust silencing systems. The silencing systems include an exhaust silencer that silences higher frequency sounds that are difficult to silence with expansion chambers. The silencer is positioned between the water trap and the atmospheric discharge and is disposed substantially vertically so as to facilitate drainage of any water therefrom and to provide further assurances that water cannot enter the engine through the exhaust system.

7 Claims, 4 Drawing Sheets

WATERCRAFT EXHAUST SYSTEM

BACKGROUND OF THE INVENTION

This invention relates to a small watercraft such as a personal watercraft and more particularly to an improved exhaust system therefore.

There is a very popular class of watercraft referred to as "personal watercraft." The watercraft that fall into this class are of a wide variety of types but have in common the feature that they are designed to be operated primarily by a single rider operator and which may carry no more than three additional passengers. Frequently, the operator sits in a straddle fashion and if passengers are accommodated they sit in tandem with the operator. This is not necessarily true in all cases but it does indicate the compact nature of this type of watercraft.

This type of watercraft is also quite sporting in nature. Because of these factors, conventional boaters have some objections to this type of watercraft.

One feature which is objected to by some people with this type of watercraft is the noise which they generate. The engine exhaust is generally silenced by utilizing a plurality of expansion chambers that are disposed between the exhaust ports and the point of discharge of the exhaust gases to the atmosphere. Because of the small space available, more sophisticated exhaust systems like utilize an automotive or larger power boat applications are not possible.

Also, it is the conventional practice with many types of water propulsion systems to silence the engine exhaust noises by cooling the exhaust gases either through water jacketing the exhaust system or by dumping cooling water from the engine cooling jacket into the exhaust system. Frequently, both of these expedients are combined.

These types of systems are effective for some sound frequencies, but not all of those experienced with engines, particularly of the two cycle type. Because of the fact that there may be a high quantity of water in the exhaust, this makes the use of other types of exhaust silencers difficult.

It is, therefore, a principal object of this invention to provide an improved silencing system for a personal watercraft.

It is a further object of this invention to provide an improved silencing arrangement for a personal watercraft that utilizes a type of silencer that silences high frequency sounds in addition to specific low frequency sounds.

SUMMARY OF THE INVENTION

This invention is adapted to be embodied in a personal watercraft having a hull that defines a rider's area for accommodating a rider operator and not more than three additional passengers. An engine compartment is provided within the hull and contains a powering internal combustion engine. This engine drives a propulsion device for propelling the watercraft through the body of water in which it is operated. The engine is provided with an exhaust system by which exhaust gases are discharged to the atmosphere. This exhaust system includes at least one water trap and expansion chamber device that receives the exhaust gases from the engine and which eventually transmits them to the atmosphere. A conduit extends from this water trap device to an atmospheric discharge. A high frequency exhaust silencer is disposed in this conduit for silencing high frequency sounds in the exhaust.

DETAILED DESCRIPTION OF THE PREFERRED EMBODIMENTS OF THE INVENTION

Figure 1:
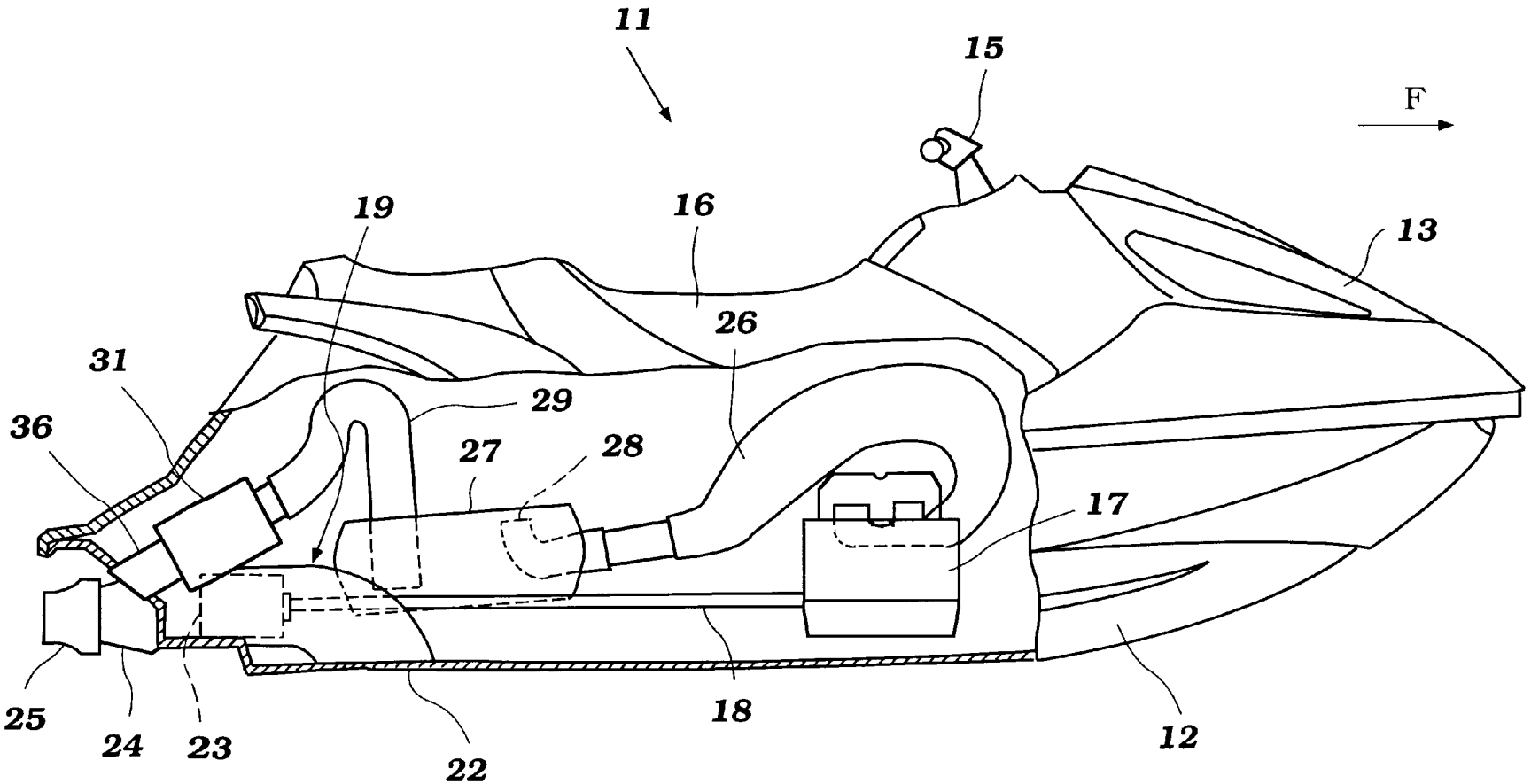
FIG. 1 is a side elevational view of a personal watercraft constructed in accordance with a first embodiment of the invention, with a portion of the hull broken away so as to show the engine, propulsion unit and exhaust system.
Figure 2:
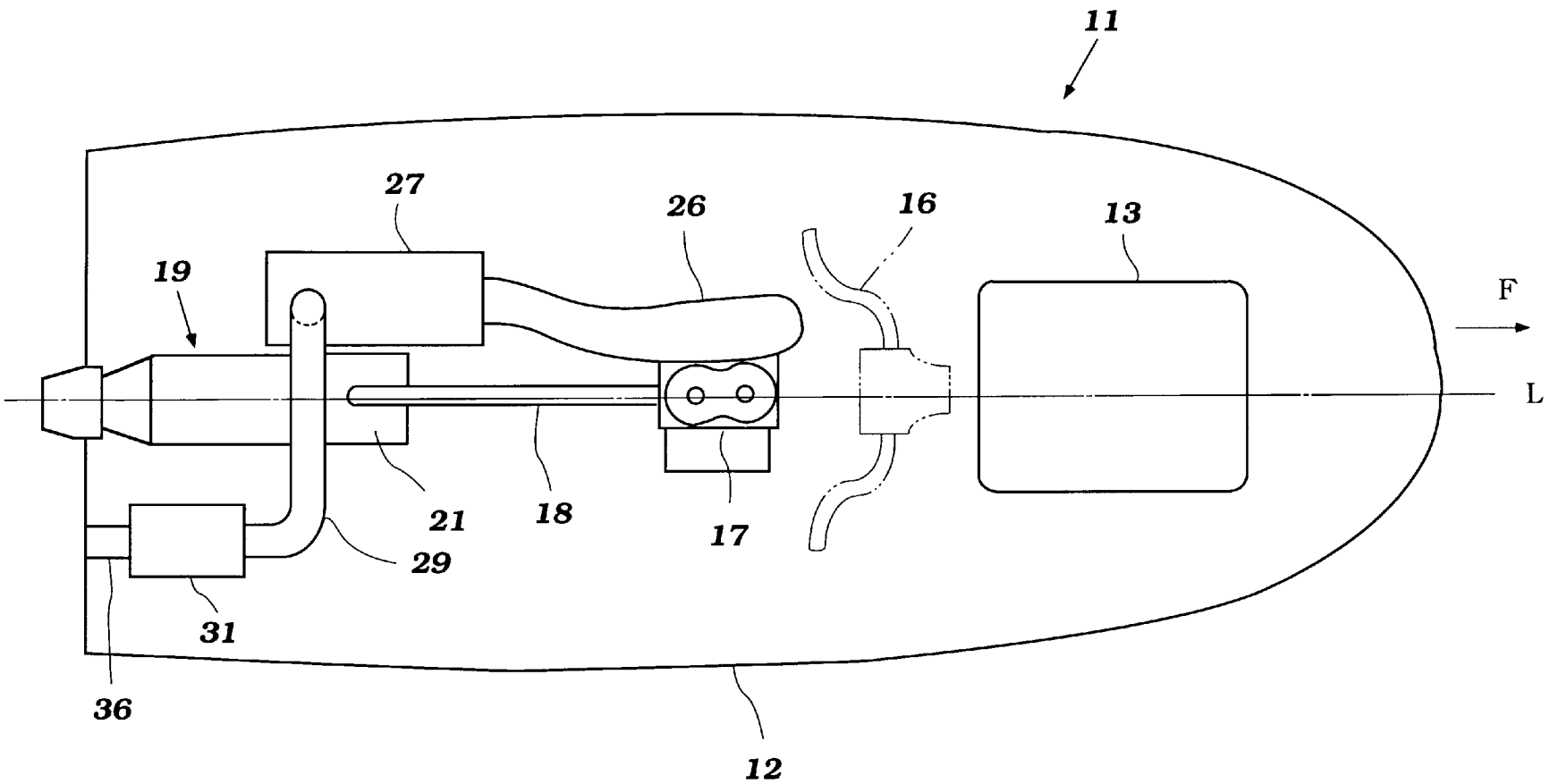
FIG. 2 is a top plan view of the watercraft shown in FIG. 1 with the hull being shown only in outline and the engine and propulsion system and exhaust being shown in solid lines.
Figure 3:
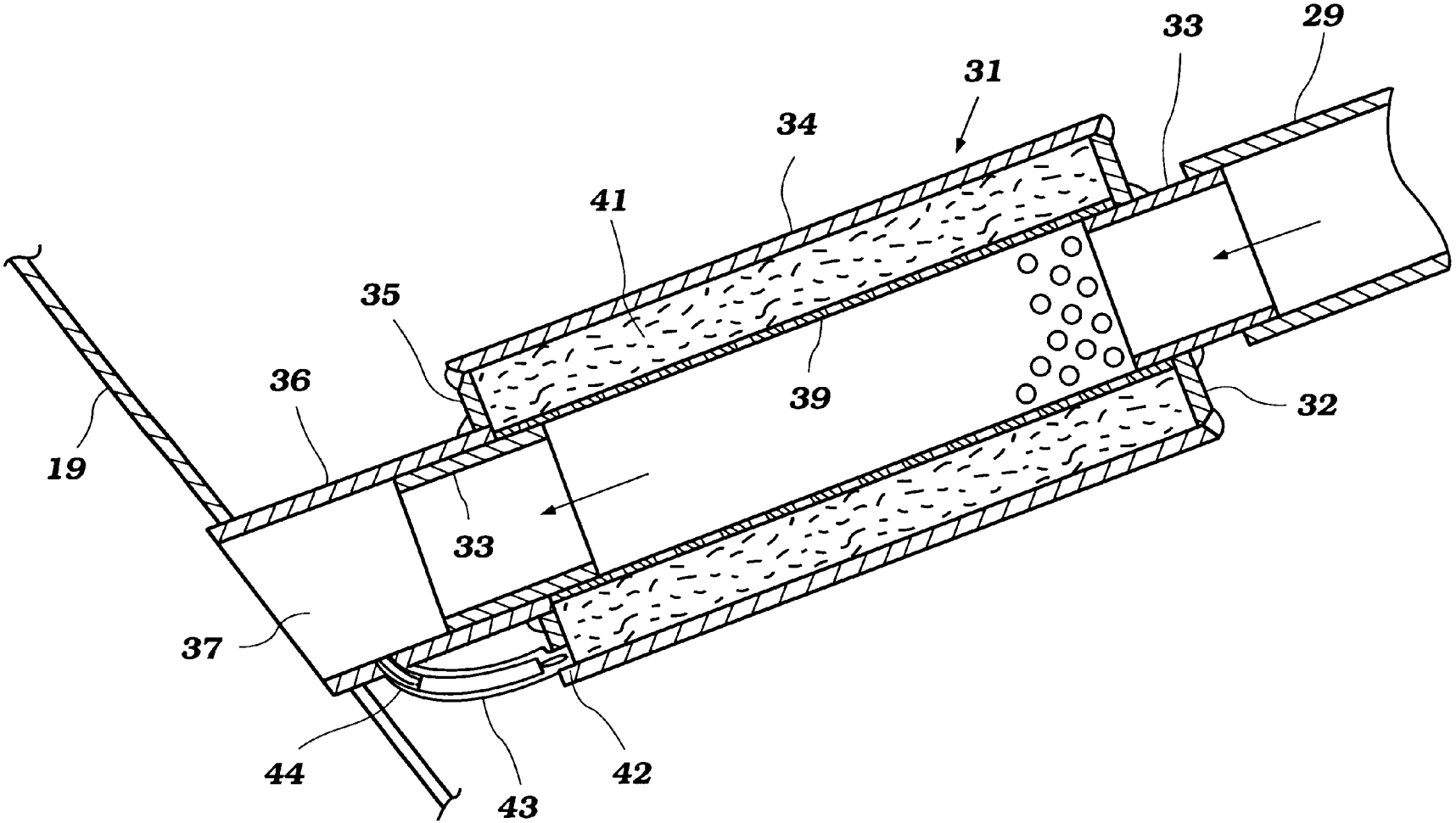
FIG. 3 is an enlarged cross-sectional view showing the silencing device associated with this embodiment and its orientation in the hull.

Referring first to the embodiment of FIGS. 1–3, a personal watercraft constructed in accordance with this embodiment is identified generally by the reference numeral 11. When the term "personal watercraft" is utilized, it is intended to encompass the type of watercraft defined in the preamble of this application as such watercraft.

The watercraft 11 is comprised of a hull assembly that is comprised of a hull 12 and a deck portion 13 which is affixed thereto. The hull 12 and deck portion 13 are formed from a suitable material such as a molded fiberglass reinforced resin or the like. The components are affixed together in a suitable manner and define an engine compartment 14.

The deck portion 13 has provided at its forward part a control mast 15 for control of the watercraft 11. A longitudinally extending seat 16 is formed behind this mast 15. The seat 16 is designed so as to accommodate a single rider operator positioned immediately behind the mast 15. Additional passengers may be carried behind the operator and they will be seated in tandem fashion. No more than three passengers normally occupy this seat 16 along with the rider operator. It should be understood that the foregoing seating arrangement is only typical of the type with which the invention may be employed.

An internal combustion engine, indicated generally by the reference numeral 17 is provided in the engine compartment 14 and is disposed beneath the seat 16. Therefore, the deck portion 13 may be formed with an access opening that can be accessed through removal of the seat 16 or a part thereof it.

The engine 17 is, in the illustrated embodiment, mounted so that its crankshaft rotates about a longitudinally extending axis L. This facilitates coupling to a driveshaft 18 which extends rearwardly and is coupled to the impeller shaft of a jet propulsion unit, indicated generally by the reference numeral 19.

This jet propulsion unit 19 includes an outer housing assembly 21 that forms a downwardly facing water inlet opening 22 through which water may be drawn from the body of water in which the watercraft 11 is operating. This water is pumped by an impeller shown schematically at 23 in FIG. 1 and is discharged rearwardly through a discharge nozzle 24 to provide a propulsion force for the watercraft 11.

As is also known in this art, a steering nozzle 25 is pivotally supported in communication with the discharge nozzle 24. The pivotal position of the steering nozzle 25 is controlled by the mast 15 for steering of the watercraft 11 in a manner well known in this art.

It should be noted that the jet propulsion unit 19 may be accommodated in part in a tunnel formed at the rearward end of the hull portion 12. A suitable bulkhead assembly isolates the engine compartment 14 from this tunnel.

The construction of the watercraft 11 as thus far described may be considered to be conventional. As has been noted above, the invention deals primarily with the exhaust system for the engine 17 and that will now be described referring initially primarily to FIGS. 1 and 2.

The engine 17 may be of any known type. However, in the illustrated embodiment it is depicted as being the two cylinder inline type that operates on a crankcase compression principal. The invention has particular utility with this type of engine because such engines frequently generate harsh, high frequency noises that may be objectionable. Of course, the invention can be utilized with engines of other types and other cylinder numbers and configurations.

A combined expansion chamber, exhaust manifold 26 has an inlet end that is fixed to a side of the cylinder block of the engine 17 and collects the exhaust gases from the exhaust port. These exhaust gases are silenced by this expansion and then are again compressed and transferred rearwardly to a water trap device 27 that is disposed on one side of the jet propulsion unit 21 and externally of the hull tunnel portion in which part of this jet propulsion unit may be contained.

The water trap device 27, as is typical in the art, has an inlet 28 at one end thereof from which the exhaust gases from the exhaust manifold 26 are delivered to an upper area of the expansion chamber formed by the water trap device 27. An exhaust discharge pipe 29 extends from a lower portion of the outer housing of the water trap device 27 vertically upwardly and crosses over the top of the jet propulsion unit 19 and the tunnel in which it is contained. This helps to assist in water separation and to ensure that water is not likely to flow backward to the engine through the exhaust system.

Normally, the pipe 29 would discharge the exhaust gases to the atmosphere. In accordance with the invention, however, a silencing device 31 is provided in this exhaust pipe 29 and has a construction as best shown in FIG. 3. The silencing device 31 is designed so as to silence high frequency sounds primarily although the range of frequencies silenced is relatively broad and can operate to silence any of a wide variety of frequencies.

The silencing device 31 has a first end plate 32 having an inlet fitting 33 that communicates with the discharge and of the exhaust pipe 29. An outer shell 34 of cylindrical configuration extends in a generally downwardly and rearwardly inclined fashion as best seen in FIG. 3. The rear end of the outer shell 34 is closed by a further end plate 35 which is connected to a discharge end 36 having an opening 37 that extends through the rearward portion of the hull 12.

An inner sleeve 38 is provided between the discharge end 36 and a perforated inner shell 39 of the silencer 31. The inlet shell 33 also is slipped into this inner shell 39. The number and the size of the perforations of the shell 39 may be appropriate chosen to provide the desired silencing. In addition, the area between the inner shell 39 and the outer shell 34 may be filled with a sound deadening material such as a fiberglass pad 41.

As is well known, engine exhaust gases contain a fairly large portion of water vapor and this is further magnified if the engine cooling system discharges into the exhaust system, as is typical with marine application. Some of this water may pass into the area between the inner and outer shell 39 and 43 and be absorbed in the packing 41. To permit this water to be discharged, a drain nipple 42 is formed at the lower end of the chamber and is connected by a flexible hose 43 to a discharge nipple 44 formed in the discharge pipe 36 of the silencer 31. Because of the generally vertical orientation, any water that accumulates and condenses will freely drain out to avoid corrosion and other problems.

Figure 4:
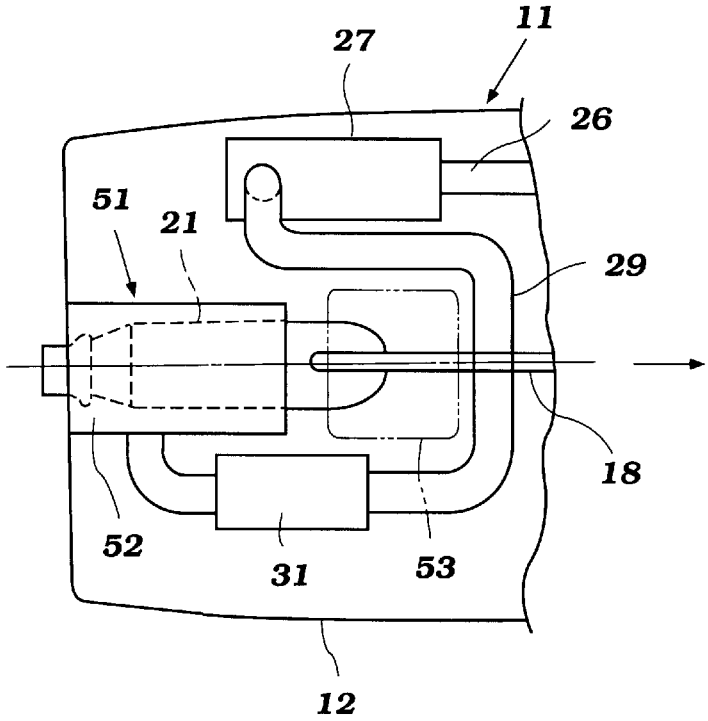
FIG. 4 is a reduced scale, partial top plan view, in part similar to FIG. 2 and shows another embodiment of the invention.
Figure 5:
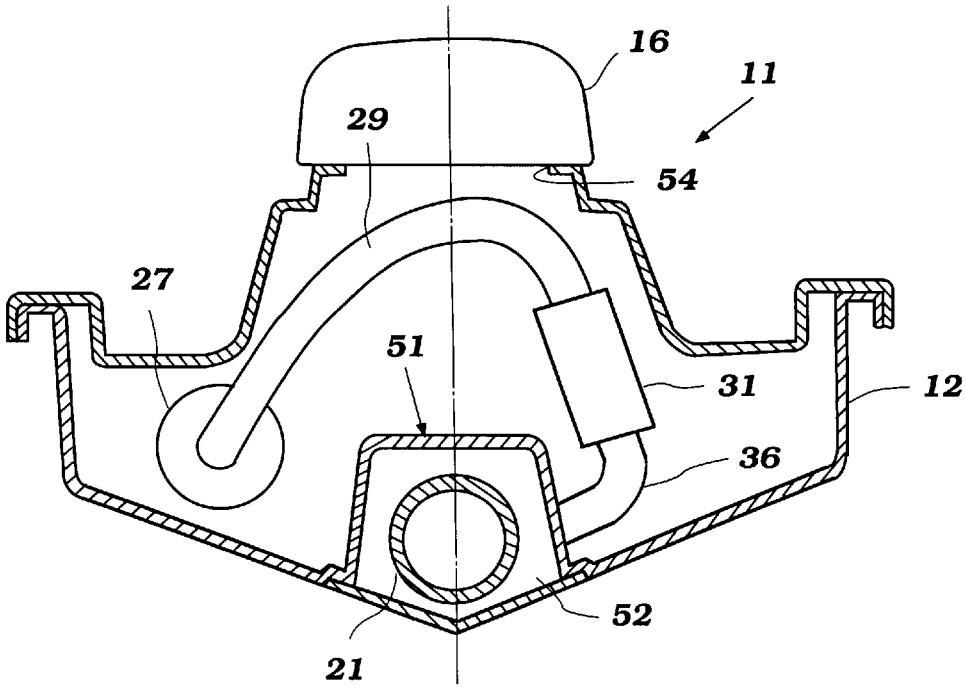
FIG. 5 is a transverse cross-sectional view taken through the hull of this embodiment, on an enlarged scale and shows the exhaust system.

In the embodiment as thus far described, the silencer 31 is provided at the extreme discharge end of the exhaust system and its outlet actually cooperates with an opening in the hull portion 12 for discharge of the exhaust gases. FIGS. 4 and 5 show the same basic components wherein, however, the exhaust gases are discharged into the aforenoted tunnel in which part of the jet propulsion unit 19 is contained. This adds to the silencing effect.

This tunnel appears in FIGS. 4 and 5 where it is identified by the reference numeral 51 and which defines an internal volume 52 that in part encircles the jet propulsion unit 19. With this embodiment, the trapped exhaust pipe 29 forwardly of the tunnel 51 and of a storage compartment indicated at 53. This storage compartment 53 is located to the rear of the seat 16 and may be accessible through a removable section of the seat 16. The silencing device 31 is located at the other side of the tunnel 51 and storage compartment 53. This silencing device 31 can be placed in an even more vertically upright position as best seen in FIG. 5 with this type of arrangement. The drain system 42, 43 and 44 is also used with this embodiment.

Thus, this embodiment also performs all of the functions of the previous embodiment and has the same advantages.

This figure also shows how the seat 16 may be provided with a removable section to open an access opening 54 above the engine compartment 14 to serve as various components.

Thus, from the foregoing description it should be readily apparent that the described embodiments of the invention provide a very effective silencing system for silencing tire frequency sounds that silence by conventional watercraft systems. Of course, the foregoing description is that of the preferred embodiment of the invention and various changes and modifications may be made without departing from the spirit and scope of the invention, as defined by the appended claims.

What is claimed is:

1. A personal watercraft having a hull that defining a rider's area for accommodating a rider operator and not more than three additional passengers, an engine compartment provided within said hull and containing a powering internal combustion engine, a propulsion device driven by said engine for propelling said watercraft through the body of water in which it is operating, said engine being provided with an exhaust system through which exhaust gases are discharged to the atmosphere, said exhaust system including at least one water trap and expansion chamber device that receives the exhaust gases from said engine, a conduit extending from said water trap device to an atmospheric discharge, and a high frequency exhaust silencer disposed in said conduit for silencing high frequency sounds in the exhaust, said high frequency exhaust silencer comprising a perforated tube surrounded by a closed chamber disposed in an inclined orientation with an inlet end disposed above an outlet end and a drain tube extending from said closed chamber downwardly to an outlet to the rear of said closed chamber.

2. A personal watercraft as set forth in claim 1 wherein the high frequency exhaust silencer has a discharge end opening directly through the watercraft hull.

3. A personal watercraft as set forth in claim 2 wherein the high frequency exhaust silencer discharge end opens through a downwardly facing opening in the hull.

4. A personal watercraft as set forth in claim 2 wherein the high frequency exhaust silencer discharge end opens into a tunnel in the underside of the hull.

5. A personal watercraft as set forth in claim 4 wherein the tunnel contains the propulsion device.

6. A personal watercraft as set forth in claim 1 wherein the water trap device is on one side of the hull and the high frequency exhaust silencer is on the other side of the hull.

7. A personal watercraft as set forth in claim 6 wherein a U shaped trap pipe section connects the water trap device with the high frequency exhaust silencer.

* * * * *